United States Patent [19]

Abramson

[11] Patent Number: 5,056,539

[45] Date of Patent: Oct. 15, 1991

[54] PRODUCT AND PROCESS FOR HIGHLIGHTING HAIR

[76] Inventor: Kevin G. Abramson, 18 Dorothy Rd., Brockton, Mass. 02402

[21] Appl. No.: 659,846

[22] Filed: Feb. 22, 1991

[51] Int. Cl.[5] ..... A45D 19/18

[52] U.S. Cl. ..... 132/270; 132/208

[58] Field of Search ..... 132/208, 270, 222, 220, 132/221

[56] References Cited

U.S. PATENT DOCUMENTS 2,107,438 2/1938 Frederics ..... 132/222

4,196,741 4/1980 Minghenelli ..... 132/270

FOREIGN PATENT DOCUMENTS 0126618 11/1984 European Pat. Off. ..... 132/208

*Primary Examiner*—Cary E. Stone

*Assistant Examiner*—Adriene B. Lepiane

*Attorney, Agent, or Firm*—Lorusso & Loud

[57] ABSTRACT

A product and method for highlighting and/or coloring selective areas of hair on a person's head is disclosed. The invention is an improved product for and method of foiling hair to achieve highlighting comprising a segment of aluminum foil having two window panes of transparent material arranged equidistant from each other such that when the foil is folded in half the two panes are aligned one on top of the other.

10 Claims, 2 Drawing Sheets

PRODUCT AND PROCESS FOR HIGHLIGHTING HAIR

BACKGROUND OF THE INVENTION

1. Field of the Invention

The present invention relates generally to the field of hair styling and more specifically to techniques for bleaching and/or coloring selective areas of hair on a person's head, while leaving other areas untouched, such techniques being known in the profession as "highlighting". The invention more specifically relates to a new, improved product and method for "highlighting" hair through "foiling" which is faster, more efficient and less expensive than existing methods and products.

2. Background of the Invention

In hair styling, selective bleaching or coloring of a client's hair is known by a number of names, including, "highlighting" or "frosting". There are three generally recognized methods of highlighting, that is, cap highlighting, combing, and foiling.

In cap highlighting, the client's hair is covered with a cap, made of a flexible material such as rubber which has a multiplicty of small holes. An instrument, such a a crochet needle, is used to pull selective strands of hair through the holes; color or bleach is then applied to the strands. The stylist waits a definable time period for the color or bleach to set properly, removes the cap, and washes the hair. The result is a selective coloring or bleaching of the hair. This method is subject to a number of problems. The liquid often "bleeds" through the holes in the cap and the bleach or coloring spreads unevenly to strands or portions of hair not intended to be highlighted, causing a spotted look. Further, pulling the hair through the cap holes is often painful if too much pressure is applied by the hair stylist. The cap method is also difficult to use when the object is merely to "touch up" the roots of those strands that were previously highlighted without adding further color or bleach to the already highlighted hair.

The combing method employs a comb which is dipped into the liquid to be applied and is then pulled through the hair. This method is usually employed where relatively large swatches of hair are to be highlighted. It is difficult to regulate and particularly vulnerable to "bleeding" of the liquid to other portions of the hair.

In the third commonly employed method, called foiling, the hair stylist utilizes pieces of foil material, usually of the ordinary kitchen variety, cut into square or rectangular pieces. The segments of hair to be highlighted are pulled forward, placed on the foil, and colored or bleached. The foil is then folded in half, sandwiching the hair segments, between the top and bottom halves. This procedure is repeated for each segment to be highlighted.

The existing method of foiling suffers from a number of disadvantages. The bottom half of the folded foil must be held against the head while the segment of hair is being painted with the liquid. There is a tendency for the foil to move or slip, causing the color or bleach to spill over or "bleed" onto those segments of hair not intended to be highlighted. The result is often a spotted, uneven effect.

Additionally, the present method of foiling often results in uneven coloring or bleaching of the hair due to another factor. In foiling, it is difficult to accurately control setting time. For example, the hair stylist will typically begin the application on the back of the head moving toward the front (or, vice versa). Because the present method is so cumbersome it is also very time consuming. Hence, those segments of hair initially colored or bleached (e.g., in the back) will set to the desired shade well before those segments finally colored or bleached (e.g., in the front). The stylist must therefore continuously check on each foiled segment while continuing to apply the color or bleach to other segments in order to avoid uneven coloring or bleaching over the head surface.

In practice, the hair stylist continuously opens and closes foiled segments, to visually observe the state of coloration. Each time a foiled segment is opened and closed there exists the risk of bleeding or of the foil disengaging from the hair if the liquid has not had enought time to set. Continuous opening and closing of the foil tends to loosen its hold on all or portions of the hair segment, causing the foil to detach from the hair or portions of the hair to escape from the foil. The result is uneven coloring/bleaching.

Further, the hair stylist is unable at any moment during the process to have a visual over-view of all of the highlighted segments. Consequently, it is difficult to precisely control the process to ensure an even coloring or bleaching throughout.

Attempts have been made to overcome these disadvantages by using pieces of thin pliable transparent plastic, such as Saran Wrap or equivalent, having a Velcro strip at one end. The plastic piece is applied over a thin parting of hair with the Velcro side towards the scalp and pressed onto the thin hair parting. Highlighting mixture is then brushed over the plastic; the hair segment to be colored is then placed directly on the plastic piece; additional highlighting mixture is brushed on the hair segment to be colored; and the strip is then folded in half.

Although this teaching allows the stylist to view the progress of the coloring, it is inefficient and cumbersome to use. The hair must be wet or damp as a pre-condition, thus at least doubling the development time of the highlighting process; the Velcro strip does not stick well to the hair; and the transparent plastic is too flimsy for the stylist to handle efficiently. Since the edges cannot be folded properly, bleeding or leakage of the coloring mixture occurs. Further, the plastic cannot be coded to allow different colors for different segments of hair.

SUMMARY OF THE INVENTION

The present invention is a product and method for foiling which is quicker, more efficient, easier and more confortable to apply, and more controllable than the existing foiling technique.

In the preferred embodiment, the aluminum foil is pre-cut to a standard sized sheet having a fold on the two opposing ends. The segment of foil has a two window panes covered with a transparent material such as cellophane. The window panes are equidistant from each other on the foil such that when the foil segment is folded in half, one window pane is aligned on top of the other, thereby allowing a clear view through the folded example, segment. No-slip adhesive is affixed to one of the aforementioned folds at one end of the segment.

The stylist pulls out a segment of hair, places the foil aginst the head under the hair segment, such that the end with the no-slip adhesive is against the head. The stylist then rests the hair segment on the foil sheet over one of the window panes. The hair segment is gently held in place by the adhesive while the color or bleach is applied. The foil sheet is then foled in half such that the two window panes are aligned, allowing a clear view of the sandwiched hair from top or bottom. The folded foil sheet is held in place by the no-slip adhesive which also prevents bleeding at the end. Bleeding is also prevented by folding the foil along its two sides.

The use of no-slip adhesive ensures that the foil remains in place, prevents bleeding, and allows the process to be applied much quicker than the previous technique. Further, the window panes allow the stylist to continuously check on the setting of the color or bleach without continuously opening and closing the foil segments. The stylist can now remove individual foil pieces when the desired shade is attained, thus achieving an even coloration over all highlighted segments of the head. Where more than one shade is desired, the foil can be color coded to dintinguish the different shades. The no-slip adhesive allows the foil to be easily and quickly removed without discomfort to the client.

DESCRIPTION OF THE PREFERRED EMBODIMENT

Figure 1:
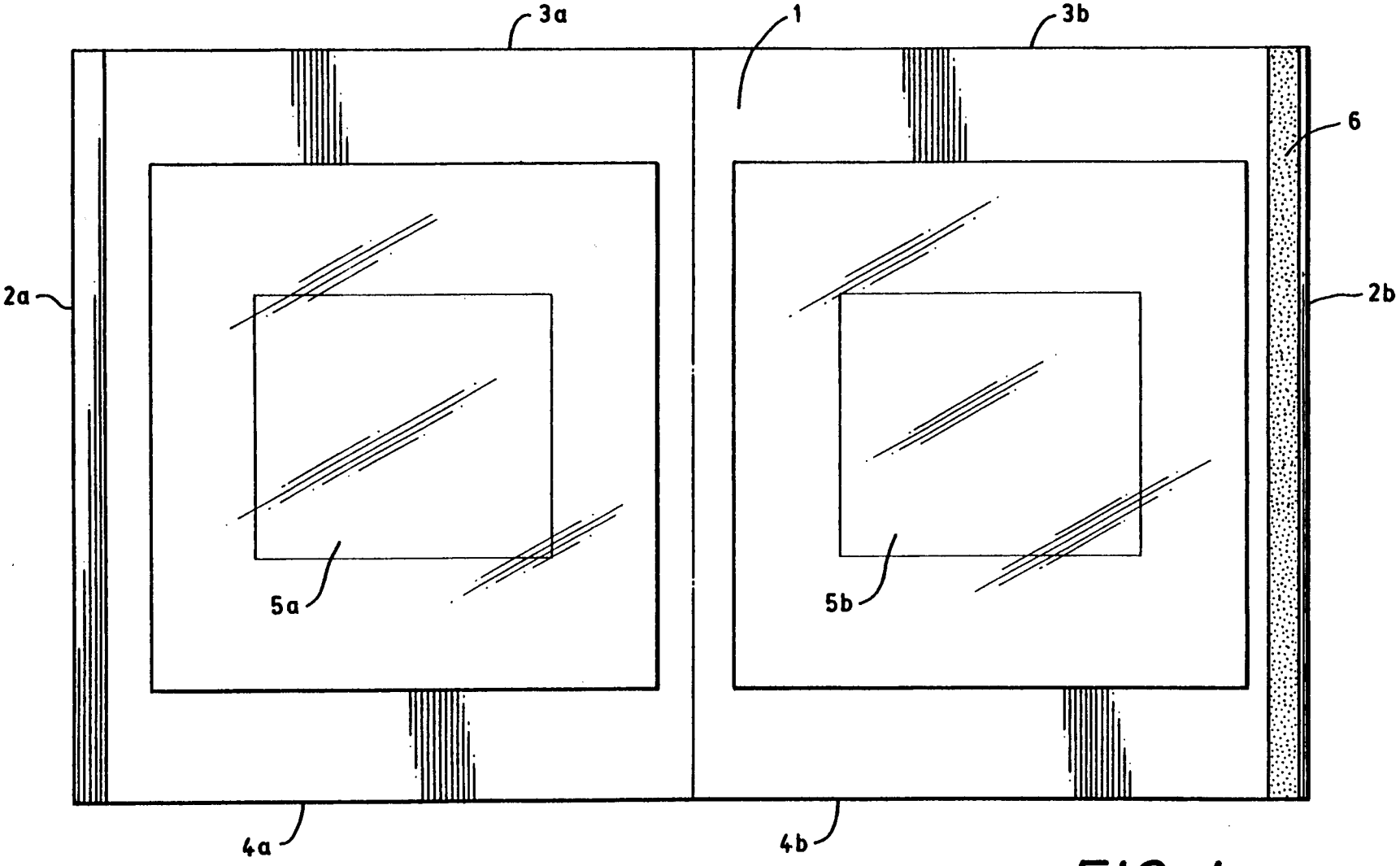
FIG. 1 is a top view of the pre-cut aluminum foil segment, showing the window panel cut-outs, as well as the two opposing folds, one of which having the no-slip adhesive.

In the preferred embodiment of FIG. 1, aluminum foil panel 1 is pre-cut into segments preferably, though not mandatorily, 5 inches by 8 inches. Each of the two opposing ends 2*a* and 2*b* along the shorter (i.e., 5-inch) ends or borders of the rectangle preferably though not mandatorily, have a 3/16 inch fold to prevent the color or bleach from running or bleeding. The other set of opposing ends 3*a*, b and 4*a*, b shown in FIG. 1 are the longer (8 inch) ends or borders of the rectangle. Window panes 5*a* and 5*b* are cut out of panel 1 so as to be the same size, (e.g., in the preferred embodiment, 2-inch by 1.75-inch). Each pane 5*a* and 5*b* is approximately in the center of its half of panel 1 and equidistant from each other, such that when panel 1 is folded in half, pane 5*a* is aligned on top of pane 5*b*. Panes 5*a* and 5*b* are covered with a transparent material such as cellophane. No-slip adhesive 6 is affixed to end 2*b*.

Figure 2:
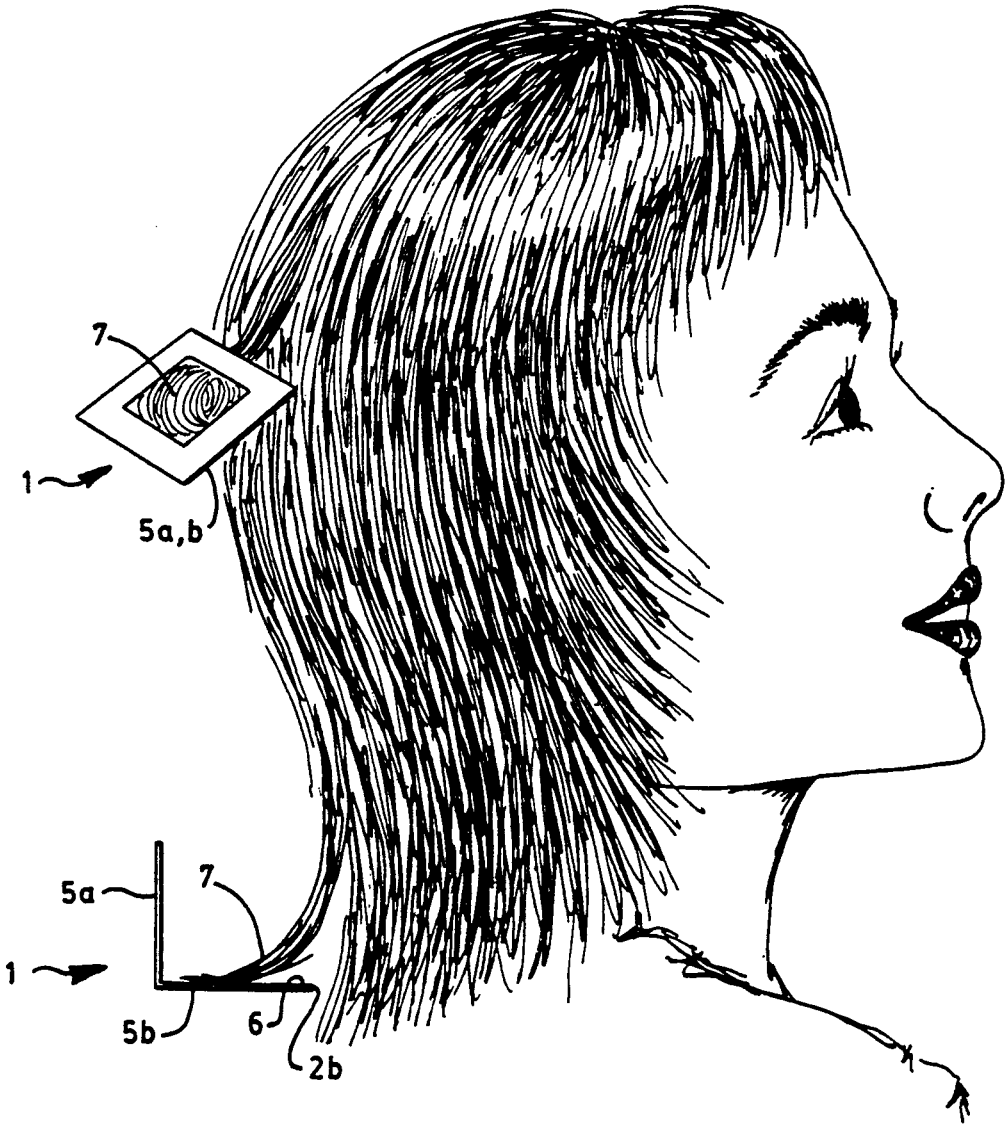
FIG. 2 is a back view of a human head showing the application of the foil segment in the process.

As shown in FIG. 2, the stylist pulls out a segment of hair, places end 2*b* of the foil against the client's head under the hair segment such that hair segment 7 is gently held in place on the foil by adhesive 6. The color or bleach is then applied to hair segment 7.

Panel 1 is thus folded in half such that window panes 5*a* and 5*b* are aligned over each other as are opposing ends 2*a* and 2*b*. Opposing ends 2*a* and 2*b* are held together by adhesive 6.

When panel 1 is folded in half, end 3*a* is aligned over end 3*b*, and end 4*a* is aligned over end 4*b*. As an added optimal feature, to further protect against bleeding or running of the liquid, ends 3*a* and 3*b* may be folded together, as may ends 4*a* and 4*b*.

The stylist now takes a second panel 1 and applies it to another segment of hair 7 elsewhere on the head, and repeats this process with other panels 1 on all desired areas of the head.

Concurrent with affixing additional panels 1 to the head, the stylist from time to time checks the color setting of the hair segments 7 which were previously highlighted, and removes those panels 1 where the hair coloration or bleaching has properly set. Hair segments 7 are simply removed from the panels 1 by opening ends 3*a*, b and 4*a*, b; then opening ends 2*a* and 2*b*. The colored or bleached hair segment 7 is then gently detached from adhesive 6. The entire hair is then washed and dried, resulting in a head of hair that is evenly highlighted. Used aluminum foil panels 1 are then disposed of.

As an optional feature, panels 1 may be color coded where more than one shade or type of color or bleached is desired.

Further, the panels 1 need not be rectangular, but can be square, triangular or other shapes provided only that the window panes 5*a* and 5*b* align when panel 1 is folded. Also, panel 1 is not limited to the dimensions given but can be cut to other dimensions as desired.

The foil may be sold separately or parlayed as part of a kit, including a package of foil and a comb and/or brush to pull out the hair segment to be highlighted and place on the foil aforementioned. The kit may contain bottles of hair coloring or bleach although hair stylists may well prefer to mix their own in accord with a client's particular coloring needs.

It is to be understood that the above description pertains to an example of the preferred embodiment of the present invention and is intended as illustrative rather than limiting. The invention is to be defined therefore not by the preceding description but by the claims that follow.

What is claimed is:

1. A product for highlighting hair through foiling; comprising:

a segment of aluminum foil having two window panes of a transparent material arranged equidistant from each other, such that when said foil is folded in half, the two panes are aligned one on top of the other, further having a fold at each of two opposing ends of said foil; and no-slip adhesive affixed to at least one of said folds.

2. The product of claim 1 wherein the segment of aluminum foil is rectangular in shape.

3. The product of claim 1 wherein the segment of aluminum foil is square in shape.

4. The product of claim 1 wherein said transparent material is cellophane.

5. The product of claim 1 wherein the foil is color coded according to the color of the highlighting desired.

6. A product for highlighting hair through foiling, comprising:

a rectangular shaped segment of aluminum foil having two equal-sized window panes of a transparent material equidistant from each other and arranged on said foil such that when said foil is folded in half, the two panes are aligned one on top of the other, and further having a pair of longer ends opposite each other, and a pair of shorter ends opposite each other;

a fold at each of said two shorter ends; and no-slip adhesive material affixed to at least one of said folds.

7. A method for highlighting hair comprising:

providing a segment of aluminum foil having two equal-sized window panes of a transparent material, and having a first set of oppositely arranged ends;

and a second set of oppositely arranged ends;

arranging said panes on said foil equidistant from each other such that when said foil is folded in half, said panes will be aligned on top of each other;

folding both of said ends in said first set to form a border on each end;

affixing a no-slip adhesive material to at least one of said ends in said first set;

pulling out that segment of hair from a head that is to be highlighted;

placing the adhesive end of said foil against the head under said hair segment;

placing said hair segment on the foil such that it rests on the adhesive and covers, at least partially, one of said panes;

applying highlighting liquid;

folding said foil in half such that said panes are in alignment over each other;

folding one of said ends in said second set over itself;

folding the other end of said second set over itself, thereby completely closing said foil segment;

repeating the above steps for others of said foils;

observing from time to time said hair segment in each of said foils by viewing through said panes;

removing each of said hair segments from each of said foils when the color or bleach is observed to be properly set; and washing and drying said hair.

8. A kit for highlighting hair comprising:

a segment of aluminum foil having two window panes of transparent material, arranged equidistant from each other, such that when said foil is folded in half, the two panes are aligned one on top of the other, and further having a fold at each of two opposing ends of said foil;

no-slip adhesive affixed to at least one of said folds; and, means for pulling out a segment of hair to be highlighted and placing said segment on said adhesive.

9. The kit of claim 8 wherein said means for pulling out said hair segment and placing it on said adhesive is a brush and a comb.

10. The kit of claim 8 further comprising a container of hair coloring or bleaching liquid.

* * * * *